US005848457A

United States Patent [19]

Silagy

[11] Patent Number: 5,848,457

[45] Date of Patent: Dec. 15, 1998

[54] LACING SYSTEM FOR TRADITIONAL FOOTWEAR

[76] Inventor: Howard Silagy, 100A Tec St., Hicksville, N.Y. 11801

[21] Appl. No.: 989,877

[22] Filed: Dec. 12, 1997

[51] Int. Cl.[6] ..... A43C 1/00

[52] U.S. Cl. ..... 24/712.1; 24/712; 24/713.9; 24/715.3; 36/50.1

[58] Field of Search ..... 24/712, 712.1, 24/713.6, 713.9, 714, 714.6, 714.5, 715.3; 36/50.1

[56] References Cited

U.S. PATENT DOCUMENTS

| | | | |
|---|---|---|---|
| 109,933 | 12/1870 | Patten | 24/713.9 |
| 787,812 | 4/1905 | Weinberg | 24/712 |
| 1,161,027 | 11/1915 | Clark | 24/714.5 |
| 1,573,119 | 2/1926 | Pambianco | 24/713.9 |
| 4,125,918 | 11/1978 | Baumann | 24/712.1 |
| 5,345,697 | 9/1994 | Quellais | 24/712 |
| 5,577,306 | 11/1996 | Gold | 24/715.3 |
| 5,640,785 | 6/1997 | Egelja | 24/712 |

FOREIGN PATENT DOCUMENTS

| | | | |
|---|---|---|---|
| 0515461 | 4/1921 | France | 24/713.9 |
| 0074626 | 3/1917 | Switzerland | 24/712.1 |
| 0001342 | 1/1888 | United Kingdom | 24/712.1 |
| 0162385 | 4/1921 | United Kingdom | 24/713.6 |

*Primary Examiner*—Victor N. Sakran
*Attorney, Agent, or Firm*—Myron Amer P.C.

[57] ABSTRACT

After purchase of a footwear article of manufacture, such as a sneaker, boot or the like, the substitution for the traditional lacing-up of the article of studs and closed loops of elastomeric construction material to facilitate the fitting on and removal of the article from a user's foot. The application of the studs and loops uses to advantage the original equipment manufacture (OEM) structural features to contribute to use on a wide range of footwear.

1 Claim, 2 Drawing Sheets

LACING SYSTEM FOR TRADITIONAL FOOTWEAR

The present invention relates generally to footwear having a facilitated lacing system, and more particularly to the application of the lacing system to a wide range of different styles and categories of footwear.

EXAMPLES OF THE PRIOR ART

A footwear article of manufacture, such as a sneaker for sports, or a boot for camping, and the like, traditionally uses a lace to close the upper about a user's foot during wear and, after use, requires unlacing to readily permit removal of the user's foot. Eschewing a lacing system which consists merely of threading a lace through eyelet-reinforced openings on side flaps bounding a front opening into the upper, prior efforts have been made to simply the lacing system. Efforts to attain this simplification using a stretchable lace are exemplified by U.S. Pat. No. 5,111,558 issued to Ridley et al. for "Durable Elastic Lace for Athletic Shoes" on May 12, 1992, or using a non-stretchable lace but with hooks as a replacement for the eyelet-reinforced openings and thus obviating the need to thread through these openings are exemplified by U.S. Pat. No. 4,125,918 issued to Allan H. Baumann for "Fastener for Lace Shoes" on Nov. 21, 1978.

In a prior U.S. patent, now singled out, issued to Sinisa Egelja under U.S. Pat. No. 5,640,785 for "Resilient Loops and Mating Hooks for Securing Footwear to a Foot" on Jun. 24, 1997, lacing simplification is achieved using both plural elastic loops and the hooks as replacement for the lacing holes which, as above noted, obviates any threading therethrough.

In the '785 patent however, the elastic loops are permanently attached to the shoe upper and thus to use the facilitated lacing system of this patent requires a purchase of an "original equipment manufacture" (OEM) shoe having attached loops, and this greatly diminishes the available style choices and disqualifies previously purchased shoes that do not have attached loops.

Broadly, it is an object to provide footwear with a facilitated lacing system overcoming the foregoing and other shortcomings of the prior art.

More particularly, it is an object to adapt a facilitated lacing system for use with a wide range of original equipment manufacture (OEM) footwear products to contribute to providing the user with an option of the use of the system with a corresponding wide range of shoe styles and end-use categories, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
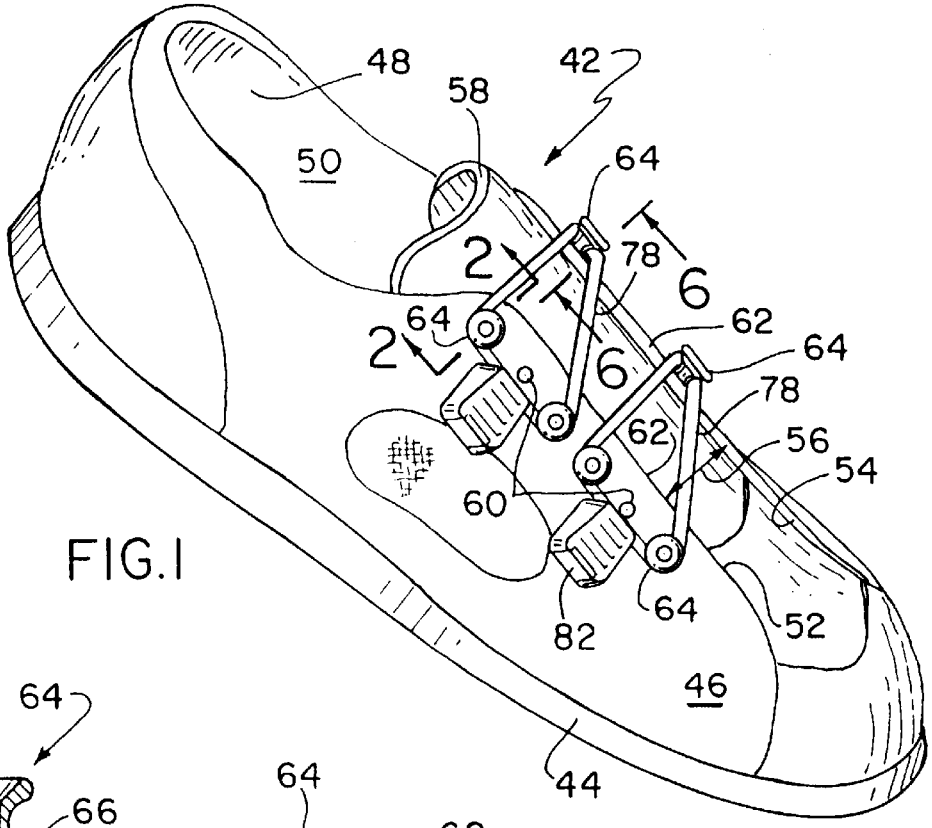
FIG. 1 is a perspective view of footwear article of manufacture having the within inventive lacing system.
Figure 3:
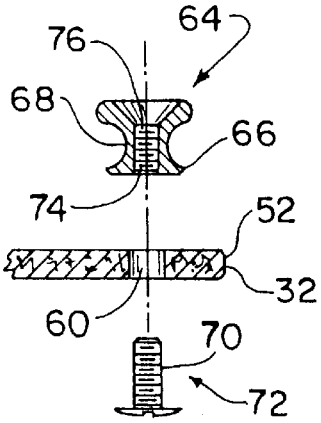
FIG. 3 is a cross sectional view similar to the cross sectional view of FIG. 2, but showing the two parts of stud component disassembled

As background to a better understanding of the within inventive shoe lacing system, reference should be made to a prior art footwear article of manufacture (OEM) generally designated 10, in the specific form of a sneaker, having a sole 12, and an upper 14 connected to the sole 12 and having an inner surface 16 bounding a foot-receiving compartment 18. Spaced apart flaps 20 and 22 located in the front of the upper 14 define therebetween an opening 24 into the foot-receiving compartment 18. Typically a tongue 26 is connected to the upper 14, as at 28, to extend in underlying relation to the spaced apart flaps 20 and 22. The lacing system of the sneaker 10, as described and illustrated in U.S. Pat. No. 5,640,785 issued to Sinisa Egelja for "Resilient Loops And Making Hooks For Securing Footwear To A Foot" on Jun. 24, 1997, contemplates the use of plural hooks or studs, individually and collectively designated 30, either permanently or replaceable located along the edges 32 of the flaps 20 and 22. Cooperating with the studs 30 are plural closed loops of elastomeric construction material, individually and collectively designated 34, in which the free ends 36 of the loops 34 are adapted to be secured to a cooperating stud(s) 30, and the opposite loop ends 38 are, as provided in an OEM condition, permanently attached, as at 40, to the upper 14.

Figure 10:
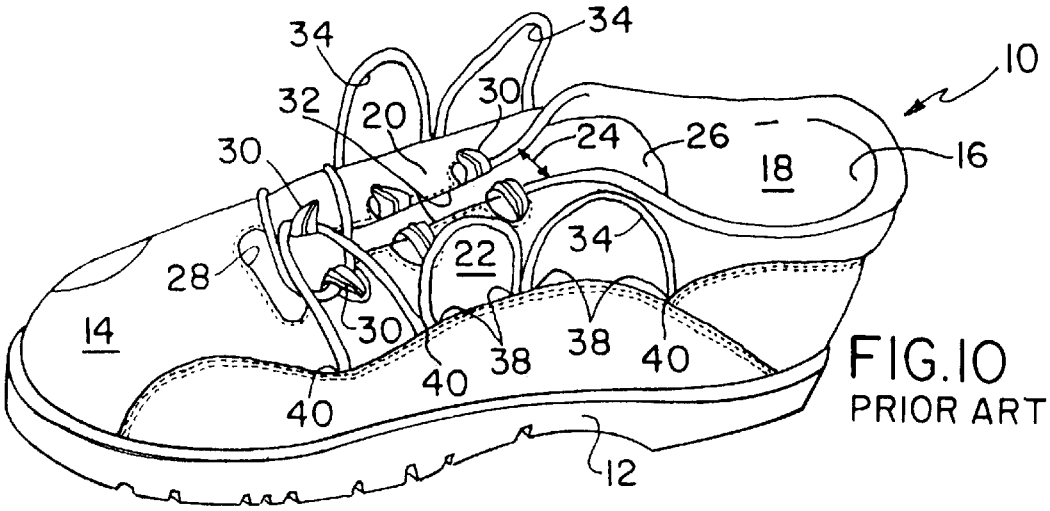
FIG.10 PRIOR ART
FIG. 10 is a perspective view, similar to FIG. 1, but of a prior art footwear supplied as an original equipment manufacture (OEM).

In the footwear article of manufacture of the within invention, generally designated 42 in FIG. 1, the attributes of an original equipment manufacture (OEM) sneaker, boot or the like, is used to advantage as part of a facilitated lacing system, thus qualifying the lacing system for all model and styles of footwear, i.e. footwear devoid of special structural features such as those designated 38, 40 on the FIG. 10 sneaker 10. Stated somewhat differently, the inventive lacing system is applied to a wide range of an after-purchased sneaker 42.

To the above end, sneaker 42 like sneaker 10 has a sole 44, an upper 46 connected to the sole 44 and having an inner surface 48 bounding a foot-receiving compartment 50, two spaced apart flaps 52 and 54 located in the front of the upper 46 defining therebetween an opening 56 into the foot-receiving compartment 50, and the usual tongue 58 connected to the upper 40 so as to extend in underlying relation to the flaps 52 and 54.

Also, as is typically provided, are plural lacing openings, individually and collectively designated 60, with or without eyelet reinforcing, located in parallel relation to the free edges 62 of the flaps 52 and 54.

Figure 2:
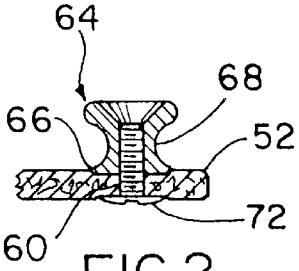
FIG. 2 is a cross sectional view, as taken along line 2—2 of FIG. 1, of a two-part stud component.
Figure 4:
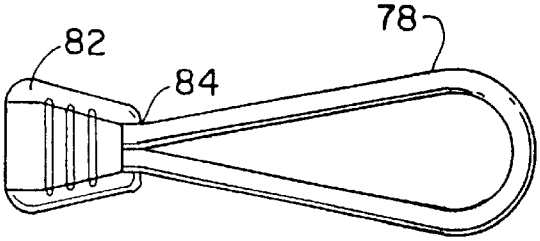
FIGS. 4 and 5 are isolated views of an elastic loop component shown respectivly in plan and in side elevation.
Figure 5:
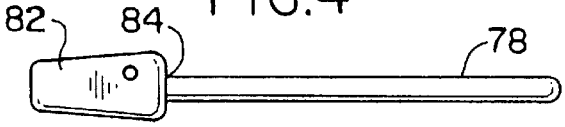

At selected locations of the openings 60, as preferably those having a triangular relationship as best shown in FIG. 1, use is made of two-part stud components, individually and collectively designated 64, each consisting of a base 66, an upstanding body 68 which, in use, extends in an accessible clearance position above a cooperating opening 60, as best shown in FIG. 2, and lastly a cooperating externally threaded, as at 70, screw 72, threadably engageable to internal threads 74 of a stud through bore 76. With the studs 64 in selected locations in their cooperating openings 60, the front opening 56 is closed about a previously inserted user's foot (not shown) in the foot-receiving compartment 50 under the urgency of the elastic construction material of loop(s) 78 disposed about a stud arrangement that consists of at least one stud 64 in each flap 52, 54.

Figure 7:
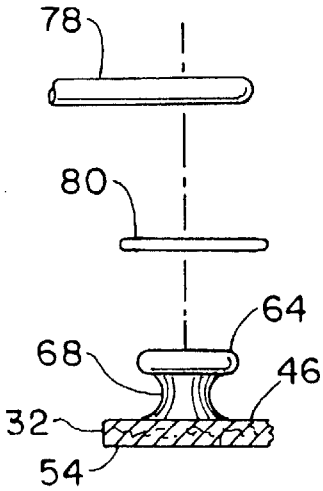
FIGS. 7, 8 and 9 are additional sectional views showing, in sequence, the engagement of an elastic loop to a stud.
Figure 8:
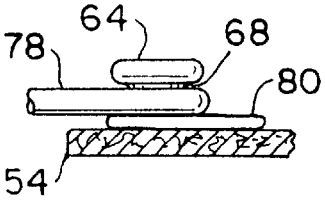

For completeness sake, it is noted as shown in FIG. 7, that use may be made of an O-ring 80, preferably of a ⅝" outside diameter and a ½" inside diameter, positioned between the upper 46 and the loop 78 which O-ring 80 as shown in FIG. 8, centers the loop 78 upon the stud body 68. Also for facilitating handling of the loop 78 a finger grip 82 is clamped, as at 84, to the loop 78.

Figure 9:
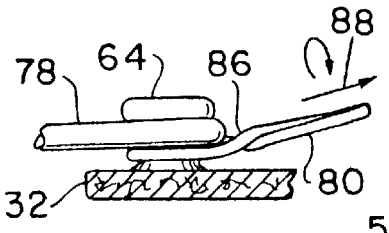
Figure 6:
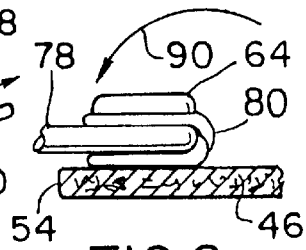
FIG. 6 is a cross sectional view as taken along line 6—6 of FIG. 1 showing engagement of an elastic loop to a stud.

If desired, and as best understood from FIGS. 9 and 6, the O-ring 80 can be twisted, as at 86, (FIG. 9), stretched, as noted at 88 and doubled over the stud 64 (FIG. 6), as noted by the arrow 90, to obviate any inadvertent disassembly of the loops 78 from cooperating studs 64.

Underlying the present invention is the recognition that sneaker 42, as above described, has embodied structural features that, by common experience, are provided by the sneaker manufacturer as original equipment manufacture (OEM), and that using to advantage these OEM structural features, there is provided a greatly facilitated lacing system which constitutes the within invention. The utilitarian use of the lacing system is thus applicable to after-purchase OEM footwear 42, whether it be a recent purchase with the latest style, or a past purchase which is still sufficiently durable to serve the purposes intended.

While the after-purchase lacing system for footwear herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. In combination, a purchaser-modified factory constructed and styled boot and stud lacing means, said boot comprising a selected one of plural factory-styled boots having an upper in a foot-encircling configuration with spaced-apart edges bounding a front opening thereinto for fitting on and taking off said boot, a tongue attached at an end adjacent a bottom of said front opening so as to extend in ascending relation therefrom in underlying relation to said front opening edges, purchaser-removed lacing operatively providing plural circular edges bounding correspondingly circular openings in parallel relation adjacent each of said front opening edges, and a plurality of stud lacing means comprising a flat head screw with a threaded shank disposed with said flat head in an interposed position between said tongue and said upper and said threaded shank thereof projected through a cooperating circular opening, each of said lacing means having a threaded opening in threaded engagement to cooperating with said threaded shank, and a plurality of manually attached closed loops of elastic construction material in a selected operative-engaged relation to said studs, whereby said stud lacing means contributes to facilitating opening and closing of said front opening of a boot having a desirable factory-embodied styling.

* * * * *